US006521579B2

(12) United States Patent
Richter et al.

(10) Patent No.: US 6,521,579 B2
(45) Date of Patent: Feb. 18, 2003

(54) USE OF N-ALKYL-BETA-ALANINE DERIVATIVES TO PREPARE CLEANING CORROSION INHIBITORS

(75) Inventors: Michael Richter, Unna (DE); Thorsten Kröller, Dorsten (DE)

(73) Assignee: Goldschmidt AG (DE)

( * ) Notice: Subject to any disclaimer, the term of this patent is extended or adjusted under 35 U.S.C. 154(b) by 0 days.

(21) Appl. No.: 09/938,750

(22) Filed: Aug. 24, 2001

(65) Prior Publication Data

US 2002/0104349 A1 Aug. 8, 2002

(30) Foreign Application Priority Data

Sep. 1, 2000 (DE) ..... 100 43 040

(51) Int. Cl.[7] ..... C11D 7/26; C11D 7/32; C11D 7/50

(52) U.S. Cl. ..... 510/264; 510/245; 510/254; 510/255; 510/477; 510/488; 510/499

(58) Field of Search ..... 510/245, 254, 510/255, 264, 477, 488, 499; 134/39, 40, 42

(56) References Cited

FOREIGN PATENT DOCUMENTS

DE 42 40 697 A1 6/1994
JP 08325770 A 12/1996
JP 11335880 A 12/1999

*Primary Examiner*—Gregory Delcotto
(74) *Attorney, Agent, or Firm*—Scully, Scott, Murphy & Presser

(57) ABSTRACT

A cleaning corrosion inhibitor based on N-alkyl-beta-alanine derivatives and their salts. The N-alkyl-beta-alanine compounds of the present invention have the general formulas (I) and/or (II)

(I)

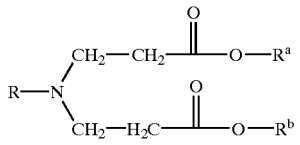

and/or (II)

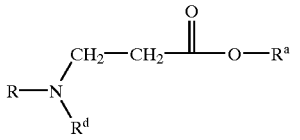

20 Claims, No Drawings

USE OF N-ALKYL-BETA-ALANINE DERIVATIVES TO PREPARE CLEANING CORROSION INHIBITORS

DESCRIPTION

Field of the Invention

The present invention relates to N-alkyl-beta-alanine derivatives and salts thereof and, more particularly, to corrosion inhibitors having a simultaneous cleaning action that comprise an n-alkyl-beta-alanine derivative or salt thereof.

BACKGROUND OF THE INVENTION

In metal working, two operations alternate with one another: forming and cleaning. Forming gives rise to new surfaces, which are particularly sensitive to exposure to water and oxygen and therefore have a strong tendency to corrode.

Corrosion inhibitors must be used in order to suppress the corrosion. A subsequent cleaning step can be carried out using an aqueous surfactant solution. These solutions are generally multicomponent mixtures comprising anionic and nonionic surfactants.

From an economic standpoint, it signifies an advancement to use a cleaning-product solution which, not only cleans, but simultaneously protects the metal against corrosion. The surfactants must advantageously be "mild", i.e., the surfantants must not be listed as hazardous substances and must be readily biodegradable.

In view of the above, there exists a need for providing a cleaning product solution which serves both as a cleaner and as a corrosion inhibiting agent.

SUMMARY OF THE INVENTION

The present invention relates to N-alkyl-beta-alanine derivatives which combine a degreasing action with corrosion protection. Specifically, the present invention relates to aqueous cleaning corrosion inhibitors which comprise N-alkyl-beta-alanine compounds of the general formulae (I) and/or (II)

(I)

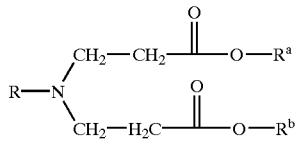

(II)

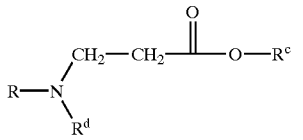

in which

R is an optionally branched hydrocarbon radical having from 8 to 18 carbon atoms and optionally containing multiple bonds, which radical may optionally contain one or more hydroxyl groups, $R^a$, $R^b$, and $R^c$, independently of one another, may be cations of an alkali metal group, ammonium salts or the protonated radical of an amine, $R^d$ is hydrogen or a $C_1$ to $C_{18}$ alkyl radical, in particular a $C_8$ to $C_{14}$ alkyl radical, which may optionally be branched and/or may contain double bonds, and the quantitative ratio of the formulae (I):(II) is from 2:0 to 0:2, preferably from 1.5:0.5 to 1:1.

In one embodiment of the present invention and when $R^d$ is a $C_{1-18}$ alkyl radical, the quantitative ratio of formula (I):(II) is approximately 0:1 to approximately 1:1.

DETAILED DESCRIPTION OF THE INVENTION

The N-alkyl-beta-alanine derivatives used in accordance with the present invention are prepared by reacting fatty amines with acrylic acid in inert solvents under reaction conditions which are known to those skilled in the art. Depending on the chosen stoichiometry of the reactants, the monoaddition products or the biaddition products are formed predominantly. The technical reaction mixtures are generally neutralized with a base or adjusted to a higher pH without further isolation of the respective pure components.

The fatty amines used in the present invention are prepared in accordance with known methods by reacting fatty acids with $NH_3$ in the presence of catalysts to give the nitrile, followed by hydrogenation to give the primary or secondary amine.

Fatty acids used, individually or in mixtures, include fatty acids such as caprylic acid, capric acid, 2-ethylhexanoic acid, lauric acid, myristic acid, palmitic acid, palmitoleic acid, isostearic acid, stearic acid, hydroxystearic acid (ricinoleic acid), dihydroxystearic acid, oleic acid, linoleic acid, petroselinic acid, elaidic acid, arachidic acid, behenic acid, and erucic acid, gadoleic acid, and also the technical mixtures obtained in the pressure splitting of natural fats and oils, such as oleic acid, linoleic acid, linolenic acid, and especially rapeseed oil fatty acid, soybean oil fatty acid, sunflower oil fatty acid, and tall oil fatty acid. In principle, all fatty acids having a similar chain distribution are suitable in the present invention.

The amount of unsaturated fractions in these fatty acids or fatty acid esters is—where necessary—adjusted to a desired iodine number by means of known catalytic hydrogenation techniques or is achieved by blending fully hydrogenated with unhydrogenated fatty components.

The iodine number, as a measure of the average degree of saturation of a fatty acid, is the amount of iodine consumed by 100 g of the compound in order to saturate the double bonds.

Preference is given in the present invention to using partially hydrogenated $C_{8/18}$ coconut and/or palm fatty acids, rapeseed oil fatty acids, sunflower oil fatty acids, soybean oil fatty acids, and tall oil fatty acids, having iodine numbers in the range of approximately 80 to 150, and especially technical-grade $C_{8/18}$ coconut fatty acids, in which context it may optionally be advantageous to select cis/trans isomers such as $C_{16/18}$ fatty acid cuts rich in elaidic acid. These are commercially customary products and are offered by a number of companies under their respective trade names.

By controlling the proportion of the compounds of the general formulae (I) and (II) that are used, it is possible to adjust the degreasing/corrosion protection properties. For example, with increased proportions of the compounds of the general formula (II) in which $R^d$ is an optionally branched alkyl radical optionally containing double bonds, or alkenyl radical, having in particular from 8 to 14 carbon atoms, formulations are obtained which not only exhibit a sufficient degreasing capacity, but give rise to excellent corrosion protection.

Preference is given in accordance with the present invention to compounds in which $R^a$, $R^b$ and $R^c$=(Na, K or the protonated radical of an amine, preferably of a mono-, di- or trialkanolamine), such as, for example, monoethanolamine, diethanolamine, especially triethanolamine, monoisopropanolamine, diisopropanolamine, methyldiethanolamine, methylethanolisopropanolamine, or mixtures thereof.

The ratio of Na, K, ammonium to protonated radical of an amine may fluctuate within wide ranges and is codetermined by the radical R and the proportion of the formulae (I) and (II). Specifically, the ratio of Na, K, ammonium to protonated radical of an amine is chosen in any case so that the water solubility of the compounds, as well as a sufficient cleaning power and corrosion protection, is ensured.

In order to formulate the aqueous corrosion inhibitors of the present invention, the compounds of the general formulae (I) and/or (II) are used in amounts of from about 0.1 to about 5% by weight, in particular from 0.5 to 3% by weight. It is also within the contemplation of the present invention to use any auxiliaries and additives which are well known to those skilled in this field, in the known, customarily employed concentrations. For example, auxiliaries and additives such as emulsifiers, foam regulators, biocides, and antioxidants may be employed in conjunction with the inventive aqueous cleaning corrosion inhibitors of the present invention.

The following examples are given to illustrate some advantages of the present invention.

EXAMPLES

Preparation Examples

Example 1

98.1 g (0.5 mol) of cocamine (commercial Armeen CD) were dissolved in 47.8 g of isopropanol at 60° C. 70.2 g (0.975 mol) of acrylic acid were added dropwise in the course of 75 minutes. As a result of the exothermic reaction, the temperature rose to 80° C. The mixture was held at this temperature for 180 minutes for subsequent reaction. The mixture was thereafter diluted with 146.3 g (0.98 mol) of triethanolamine. The isopropanol was distilled off in vacuo at 80° C. The remaining product was dissolved in water and adjusted to a pH of 9.8 using KOH.

Example 2

34.5 g (0.48 mol) of acrylic acid were added dropwise to 63.9 g (0.246 mol) of tallowamine in 36.1 g of isopropanol at 70° C. As a result of the exothermic reaction, the temperature rose. The subsequent reaction was conducted at 80° C. The resulting product was diluted with 71.5 g of triethanolamine. The isopropanol was distilled off, the residue was dissolved in water and the solution was brought to a pH of 10.9 using KOH.

Example 3

In a procedure analogous to that in examples 1 and 2 (although without solvent), 95.0 g (0.5 mol) of cocamine were reacted with 36.0 g (0.5 mol) of acrylic acid. The resultant, high-viscosity product was diluted with 75 g of triethanolamine and dissolved in water and the solution was adjusted to a pH of 10.3 using KOH.

Example 4

In accordance with examples 1 and 2, 36.2 g (0.15 mol) of dioctylamine were reacted with 10.8 g (0.15 mol) of acrylic acid in the presence of isopropanol. The TEA, i.e., triethanolamine, salt was dissolved in water and the solution was brought to a pH of 10.7 using KOH.

Example 5

In accordance with example 1, 0.5 mol of a mixture of octylamine and stearylamine (1:2) was reacted with 1.0 mol of acrylic acid. Dilution was carried out in the first step with 0.2 mol of monoethanolamine and in the second step with 0.78 mol of triethanolamine. Following removal of the isopropanol by distillation, the product was dissolved in water and the solution was adjusted to a pH of 10 using NaOH.

Example 6

In accordance with example 1, 0.5 mol of dodecylamine was reacted with 1.0 mol of acrylic acid. Following dilution with 0.08 mol of monoethanolamine and then with 0.9 mol of triethanolamine, distillative removal of the iso-propanol and dissolution of the product in water, the solution was adjusted to a pH of 9.0 using KOH.

Comparative Example n-hexylamine was reacted in accordance with example 6.

To assess the degreasing action of the N-alkyl-beta-alanine derivatives of the present invention, a metal degreasing test was conducted:

100 ml of the 2% strength surfactant solution were introduced into a 1 l screw-top plastic bottle. Two stainless steel plates (30×15×5 mm) were dipped in mineral oil, allowed to drip dry briefly, and then added. The bottle was closed and shaken for 2 minutes on the shaker machine with a frequency of 180 directional changes/minute. The plates were transferred to a 50 ml screw-top bottle and treated with 15 g of chloroform for 3 minutes in an ultrasound bath. The chloroform solution was pipetted into a round-bottomed flask and concentrated. The flask was weighed before and after.

The results are shown in table 1:

| $R^a$, $R^b$, $R^c$ = triethanolamine/ K cation | Amount of oil remaining on the plates (mg) | Appearance of the water phase |
|---|---|---|
| Blank value | 159 | Oil droplets, no emulsion |
| Comparative example | 125.7 | Oil droplets, no emulsion |
| Example 1 | 31.5 | Fine emulsion |
| Example 2 | 37.2 | Emulsion with very few oil droplets |
| Example 3 | 54.0 | Emulsion with very few oil droplets |
| Example 4 | 34.1 | Fine emulsion |
| Example 5 | 16 | Fine emulsion |
| Example 6 | 28.1 | Fine emulsion |

Corrosion Protection Test

This was carried out in accordance with the filings/filter paper test in accordance with DIN 51360, Part 2.

1.0 g of the test substance was dissolved in 50, 60 or 80 g of water with a hardness of 1.79 mmol/l. 2.0 g of gray cast iron filings were weighted out into a Petri dish whose base was lined with a circular filter. The filings were wetted with 2.0 g of the prepared mixture. The Petri dish was covered and left to stand at room temperature for 2 hours. After this time, the filter was rinsed with water to remove the filings and was left to dry in the air. The signs of corrosion are assessed visually in accordance with DIN 51360 Part 2. The ratings were as follows: 0/0=no rust patterns on either filter paper of the dual determination; 4/4=extensive rust patterns. The other pairs of values indicate the corresponding values in between.

TABLE 2

| Substance:water | 1:50 | 1:60 | 1:80 |
|---|---|---|---|
| Comparative Example | 4/4 | | |
| Example 1 | 0/0 | 0/1 | 3/4 |
| Example 2 | 0/0 | | 4/4 |
| Example 3 | 0/0 | 0/1 | |
| Example 4 | 0/0 | 0/0 | 0/0 |
| Example 5 | 0/0 | 0/0 | 2/2 |
| Example 6 | 0/0 | 0/0 | 2/2 |

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the spirit and scope of the appended claims.

What is claimed is:

1. A method of cleaning a metal while simultaneously providing a corrosion inhibitor to said metal, said method comprising the step of applying to a metal needing cleaning an aqueous solution comprising a compound of general formula (I)

(I)

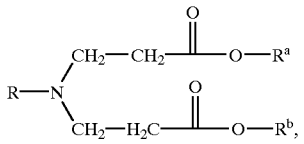

general formula (II), (II)

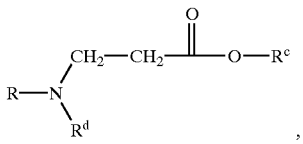

or a mixture of (I) and (II), in which

R is a substituted or unsubstituted, straight-chain or branched hydrocarbon radical having from 8 to 18 carbon atoms, $R^a$, $R^b$, and $R^c$, independently of one another are cations of the alkali metal group, ammonium salts or the protonated radical of an amine, $R^d$ is hydrogen or a $C_1$ to $C_{18}$ alkyl radical which may optionally be branched and/or may contain double bonds, and the quantitative ratio of the formulae (I):(II) is from 2:0 to 0:2.

2. The method of claim 1 wherein the quantitative ratio of formulae (I):(II) is from approximately 1.5:0.5 to approximately 1:1.

3. The method. of claim 1 wherein the quantitative ratio of formulae (I):(II) is from approximately 0:1 to approximately 1:1 if $R^d$ is a $C_1$ to $C_{18}$ alkyl radical.

4. The method of claim 1 wherein the radical R is derived from coconut fatty acid, palm kernel fatty acid, tallow fatty acid, oleic acid or mixtures thereof.

5. The method of claim 1 wherein the radicals R and $R^d$ independently of one another are straight-chain or branched hydrocarbon radicals having from 8 to 18 carbon atoms and optionally containing double bonds.

6. The method of claim 1 wherein the radical $R^d$ is derived from coconut fatty acid, palm kernel fatty acid, tallow fatty acid, oleic acid or mixtures thereof.

7. The method of claim 1 wherein said compounds of general formulas (I) and/or (II) are used in an amount of from about 0.1 to about 5% by weight.

8. The method of claim 7 wherein said compounds of general formulas (I) and/or (II) are used in an amount of from about 0.5 to about 3% by weight.

9. The method of claim 1 further comprising at least one auxiliary or additive.

10. The method of claim 9 wherein said at least one auxiliary or additive is an emulsifier, a foam regulator, a biocide or an antioxidant.

11. The method of claim 1 wherein $R^a$, $R^b$ and $R^c$ are Na, K or protantated radicals of mono-, di- or trialkanolamines.

12. The method of claim 11 wherein said mono-, di, or trialkanolamine is monoethanolamine, diethanolamine, triethanoiamine, monoisopropanolamine, diisopropanolamine, methydiethanolamine, methylethanolisopropenol amine or mixtures thereof.

13. The method of claim 1 comprising a) from 0.5 to 5% by weight of at least one compound of the general formulae (I) or (II), b) from 0 to 2.0% by weight of an emulsifier, c) from 1 to 0.5% by weight of a defoamer, d) water added to form a 100% by weight solution.

14. A corrosion inhibitor comprising a) from 0.5 to 5% by weight of at least one compound of general formulae (I) or (II), (I)

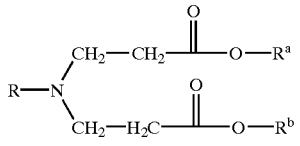

(II)

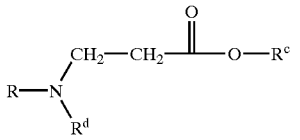

in which R is a substituted or unsubstituted, straight-chain or branched hydrocarbon radical having from 8 to 18 carbon atoms, $R^a$, $R^b$, and $R^c$, independently of one another are cations of the alkali metal group, ammonium salts or the protonated radical of an amine, $R^d$ is hydrogen or a $C_1$ to $C_{18}$ alkyl radical which may optionally be branched and/or may contain double bonds, b) from 0 to 2.0% by weight of an emulsifier, c) from 1 to 0.5% by weight of a defoamer, d) water to 100% by weight.

15. The corrosion inhibitor of claim 14 wherein the quantitative ratio of formulae (I):(II) is from approximately 1.5:0.5 to approximately 1:1.

16. The corrosion inhibitor of claim 14 wherein the quantitative ratio of the formulae (I):(II) is from approximately 0:1 to approximately 1:1 if $R^d$ is a $C_1$ to $C_{18}$ alkyl radical.

17. The corrosion inhibitor of claim 14 wherein the radical R is derived from coconut fatty acid, palm kernel fatty acid, tallow fatty acid, oleic acid or mixtures thereof.

18. The corrosion inhibitor of claim 14 wherein the radicals R and $R^d$ independently of one another are straight-chain or branched hydrocarbon radicals having from 8 to 18 carbon atoms.

19. The corrosion inhibitor of claim 18 wherein the radicals R and $R^d$ further contain a double bond.

20. The corrosion inhibitor of claim 14 wherein the radical $R^d$ is derived from coconut fatty acid, palm kernel fatty acid, tallow fatty acid, oleic acid or mixtures thereof.

* * * * *